US007631786B2

(12) United States Patent
Finlay et al.

(10) Patent No.: US 7,631,786 B2
(45) Date of Patent: Dec. 15, 2009

(54) DISPENSER ASSEMBLY HAVING A POROUS FLOW CONTROL MEMBER

(75) Inventors: Patrick J. Finlay, New Fairfield, CT (US); Kenneth A. Ritsher, Chicago, IL (US); James M. Collins, Arlington, MA (US); Andrzej Skoskiewicz, Menlo Park, CA (US)

(73) Assignee: Pepsico, Inc., Purchase, NY (US)

( * ) Notice: Subject to any disclaimer, the term of this patent is extended or adjusted under 35 U.S.C. 154(b) by 478 days.

(21) Appl. No.: 11/081,280

(22) Filed: Mar. 16, 2005

(65) Prior Publication Data

US 2005/0242123 A1 Nov. 3, 2005

Related U.S. Application Data

(60) Provisional application No. 60/553,550, filed on Mar. 17, 2004.

(51) Int. Cl.
*B67D 5/58* (2006.01)

(52) U.S. Cl. ..... 222/189.1; 222/545

(58) Field of Classification Search ..... 222/189.1, 222/402.13, 506, 544, 545, 190, 396, 402.15, 222/402.12
See application file for complete search history.

(56) References Cited

U.S. PATENT DOCUMENTS 2,091,042 A * 8/1937 Hedges ..... 251/120
2,284,135 A * 5/1942 Cornelius ..... 210/448
2,746,641 A * 5/1956 King ..... 222/2
2,789,654 A * 4/1957 Zurit ..... 96/148
3,677,300 A * 7/1972 King ..... 138/42
3,823,743 A * 7/1974 King ..... 138/42
4,077,542 A * 3/1978 Petterson ..... 222/649
4,122,978 A * 10/1978 Guimond et al. ..... 222/402.1
4,142,652 A * 3/1979 Platt ..... 222/402.2
4,995,976 A * 2/1991 Vermes et al. ..... 210/266
5,156,335 A * 10/1992 Smith et al. ..... 239/33
5,545,315 A * 8/1996 Lonneman ..... 210/120
6,688,492 B2 * 2/2004 Jaworski et al. ..... 222/1
2004/0173556 A1 * 9/2004 Smolko et al. ..... 215/11.5

* cited by examiner

*Primary Examiner*—Lien T Ngo
(74) *Attorney, Agent, or Firm*—Banner & Witcoff, Ltd.

(57) ABSTRACT

A dispenser assembly that can be used as a dispenser on a container includes a dispenser body having a flow passage, and a porous flow control member positioned in the flow passage such that the liquid must pass through at least a portion of the porous flow control member before being dispensed. The porous flow control member is operable to vary a resistance to flow of the liquid through the dispenser assembly during dispensing. A valve is provided and is movable between an open position that allows the liquid to be dispensed and a closed position that prevents the liquid from being dispensed. A discharge spout directs the flow of liquid discharged from the container. A dip tube is attached to the dispenser body and extends inside the container to supply the liquid to be discharged to the dispenser body. An attachment portion is provided to attach the dispenser assembly to the container.

15 Claims, 10 Drawing Sheets

DISPENSER ASSEMBLY HAVING A POROUS FLOW CONTROL MEMBER

RELATED APPLICATION

This application claims the benefit of U.S. Provisional Application No. 60/553,550 filed Mar. 17, 2004, which application is incorporated ion its entirety into the present application by reference.

BACKGROUND OF THE INVENTION

Post-mix fountains for dispensing carbonated beverages, such as sodas, have been used for years in various venues, such as convenience stores and restaurants. Post-mix fountains combine the ingredients of the carbonated beverage (e.g., syrup or concentrate and carbonated water) immediately prior to the beverage begin dispensed into a glass. Such fountains are convenient and economical because they allow the convenience store or restaurant owner to purchase large quantities of syrup or concentrate and carbon dioxide used to make the beverage at bulk prices. Furthermore, less waste is produced and less space is used up by packaging, since the ingredients of the fountain beverage come in large containers, rather than smaller containers sold to consumers, such as, for example, twelve ounce beverage cans or two liter bottles. In addition, the fountain is convenient for uses to operate, because there is no need to open bottles or cans to fill a glass with beverage. One of the benefits of post-mix fountains is their ability to dispense each poured serving of beverage at a uniform carbonation level, typically using the carbonation level of a bottled or canned beverage as a reference.

These fountains typically require a separate canister of gas, such as carbon dioxide gas, to carbonate water that is mixed with the syrup to form the beverage, and to propel or pump the syrup from its container. Although this arrangement is appropriate for large-scale users such as convenience stores and restaurants, it is less advantageous for smaller-scale users, such as home users. However, home users can still realize many of the benefits of fountains, particularly the lower cost, reduced waste, and ease of use that such fountains offer.

Seltzer bottle for dispensing seltzer water from a bottle are also known in the art. These seltzer bottles typically use the carbonation of the seltzer water itself to propel it from the bottle, and do not require an additional container of the seltzer water itself to propel it from the bottle, and do not require an additional container of carbon dioxide. However, there are several drawbacks associated with this type of seltzer dispenser. For instance, such seltzer bottles are difficult to control and often are discharged with substantial force, causing the seltzer water to spray out of control. When seltzer water is dispensed in this manner foaming may occur, which causes the dispensed seltzer water to lose some of its carbonation and become "flat". Another drawback with this type of seltzer bottle is that the pressure in the seltzer bottle is often depleted before all the contents of the container have been dispensed. Thus, a residual amount of unused material remains in the bottle and cannot be dispensed because there is insufficient pressure remaining to propel the residual material from the container.

The present inventors found that the pressure within such conventional seltzer bottles fluctuates as the beverage is depleted. That is when the seltzer bottle is full, the pressure within the bottle is at a maximum. As the seltzer bottle becomes depleted, the pressure within the bottle becomes correspondingly depleted. Since the pressure within the seltzer bottle decreases during its use, it follows that the pressure available to propel the beverage out of the bottle decreases as well. Therefore, the beverage may be propelled out of the bottle too quickly when the bottle is full and/or too slowly when the bottle is less than full.

Conventional cans of carbonated beverages are relatively inexpensive, but have the disadvantage that once they are opened, they cannot be resealed. Once opened, the carbon dioxide or other gas dissolved in the beverage gradually comes out of solution or "leaks." Thus, if not consumed shortly after being opened cans of carbonated beverage will become flat. Accordingly, cans are not suitable for storing multiple servings of carbonated beverages.

Bottles are superior to cans in that they are able to be resealed after being opened, but when opened, the carbonation still escapes from the bottle. Thus, after a bottle has been opened several times, the beverage will begin to become flat. For this reason, even bottles are not well suited for containing multiple servings of carbonated beverages.

There is, therefore, a need in the art for a beverage dispenser that is inexpensive, easy for a home user to use, and that eliminates the problems associated with the prior art dispensers, cans, and bottles. The present invention is directed to remedying these and other deficiencies of the prior art dispensing devices.

SUMMARY OF THE INVENTION

Accordingly, the present invention advantageously provides an easy-to-use dispenser assembly that realizes the benefits of both fountain- and seltzer bottle-type dispensers, including reduced waste and the beneficial economics of bulk purchasing, yet does not require an additional, cumbersome tank of carbon dioxide gas.

In addition, the present invention provides a dispenser assembly that is capable of restricting the rate at which a liquid is dispensed from a container and prevents foaming of the dispensed liquid, while also allowing substantially all of the liquid to be dispensed from the container. The dispenser assembly also maintains the dissolved carbon dioxide gas in the beverage longer than conventional dispensers, cans, and bottles, since the dispenser assembly is never open to the atmosphere.

Moreover, the present invention provides a dispenser assembly that is able to vary the resistance to flow of the liquid during dispensing. In particular, the dispenser assembly of the present invention is capable of dispensing the liquid contained in the container at a substantially constant rate, regardless of a change in the pressure inside the container.

In one aspect, a dispenser assembly according to the present invention comprises a dispenser body having a flow passage, and a porous flow control member positioned in the flow passage such that the liquid must pass through at least a portion of the porous flow control member before being dispensed. The porous flow control member is operable to vary a resistance to flow of the liquid through the dispenser assembly during dispensing. A valve is provided and is movable between an open position that allows the liquid to be dispensed and a closed position that prevents the liquid from being dispensed. A discharge spout directs the flow of liquid discharged from the container. A dip tube is attached to the dispenser body and extends inside the container to supply the liquid to be discharged to the dispenser body. An attachment portion is provided to attach the dispenser assembly to a container.

In another aspect of the present invention, the porous flow control member comprises a piece of rigid material and is movable relative to the flow passage to vary a length of the porous flow control member that the liquid must pass through before being dispensed, in order to vary the resistance to flow of the liquid.

In still another aspect of the present invention, the porous flow control member comprises a deformable material, wherein deformation of the porous flow control member varies the resistance of the porous flow control member to flow of the liquid.

In yet another aspect of the present invention, the beverage dispenser may comprise a plurality of porous flow control members, wherein the dispenser body further comprises a plurality of flow passages, and wherein each of the plurality of flow passages has one of the plurality of porous flow control members disposed therein.

Moreover, the present invention is directed to a method of controlling dispensing of a liquid from a container, comprising the steps of providing a dispenser assembly having a flow passage, positioning a porous flow control member in the flow passage such that the liquid must pass through the porous flow control member before being dispensed, and controlling the porous flow control member to vary the resistance to flow of the liquid.

These and other features and advantages of the present invention will become apparent from the description of the preferred embodiments, with reference to the accompanying drawing figures.

DETAILED DESCRIPTION OF THE PREFERRED EMBODIMENTS

Figure 1B:
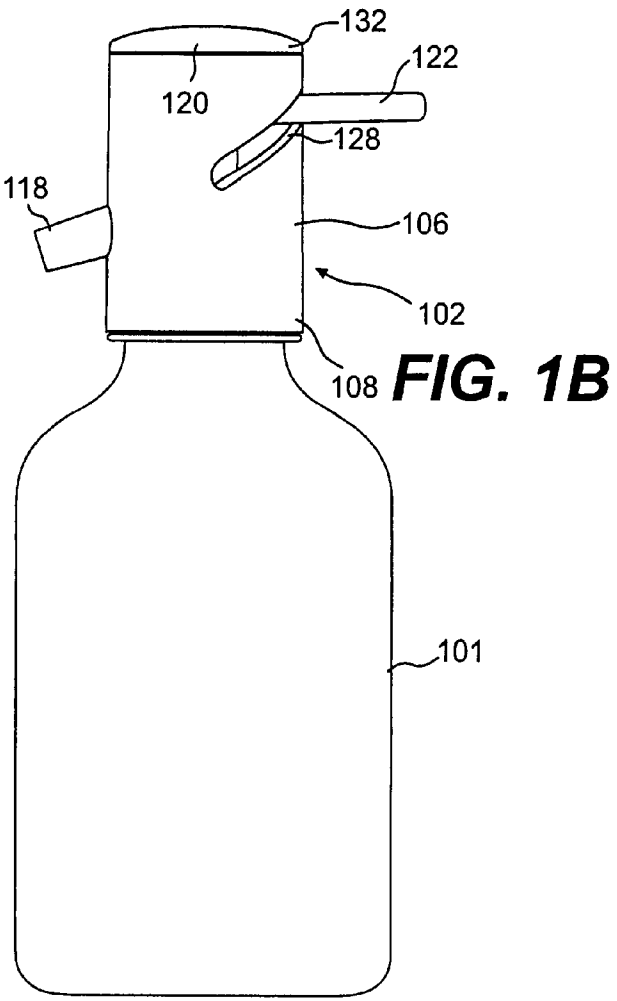
FIG. 1B is a front view showing the first embodiment of the dispenser assembly of the present invention in an open, dispensing state.

The present invention provides an easy-to-use dispenser assembly that realizes the benefits of both fountain- and seltzer bottle-type dispensers, including reduced waste and the beneficial economics of bulk purchasing, but does not require an additional, cumbersome tank of carbon dioxide gas. Additionally, the dispenser assembly of the present invention restricts the rate of dispensing of a beverage and prevents foaming, while also allowing substantially all of the beverage to be dispensed from a container at a uniform carbonation level. In particular, the dispenser assembly is capable of dispensing the beverage contained in the container at a substantially constant rate, regardless of a change in the pressure inside the container during use.

To accomplish these and other features, the present invention comprises a dispenser assembly for dispensing a carbonated beverage from a container, using the pressure generated by carbonation in the carbonated beverage itself to propel the beverage out of the container. Thus, the dispenser assembly does not require any additional cumbersome tank of propellant and can be manufactured in a convenient size for home use. Alternatively, the dispenser assembly could be manufactured and sold as a separate kit for attachment to a conventional bottle, such as a two liter soda bottle. Moreover, the present inventors anticipate that the dispenser assembly of their invention may also be advantageously used in connection with non-carbonated liquids, using another method, such as a separate source of propellant or gravity to dispense the liquid from the container.

The dispenser assembly includes a dispenser body that defines a flow passage for flow of the beverage during dispensing. A porous flow control member (PFCM) is positioned in the flow passage, such that at least some of the beverage must pass through at least a portion of the PFCM before being dispensed. The PFCM provides resistance to the flow of the beverage during dispensing, allowing the beverage to be dispensed at a restricted rate of flow. By restricting the rate of dispensation of the beverage, the flow of the beverage remains steady and is easily controlled by a user. Because the gas in the head-space of the container is never allowed to vent to the atmosphere during dispensing (i.e., because the dip tube is always submerged in the beverage contents), the beverage in the container retains its carbonation longer. Also, by restricting the rate of dispensing, the amount of foaming of the dispensed beverage is reduced and the beverage advantageously retains more of its carbonation "in the glass."

The PFCM is operable to vary the resistance to flow of the beverage during dispensing. As used herein, the term "operable" should be construed broadly to encompass the ability (either alone or in combination with one or more other elements) to translate or rotate relative to another element, to change in shape, size, density, porosity, and/or compaction, to change a portion or area through which liquid is allowed to flow, or to otherwise change one or more physical or chemical characteristics. Similar to a conventional seltzer bottle, the pressure within the container decreases as the beverage is depleted. Therefore, when the container is full and the pressure within the container is at a maximum, the PFCM is operable to provide significant resistance to the flow of the beverage. Thus, the beverage can be dispensed at a manageable rate of flow and foaming is minimized. As the container starts to become depleted and the pressure within the container correspondingly decreases, the PFCM is operable to reduce the amount of resistance to flow of the beverage, so that less pressure is required to dispense the beverage and substantially all of the beverage can be dispensed. Depending on the particular application, the PFCM can be made of ceramic, metal, glass, plastic, organic material, a polymer, or a composite thereof. Further, the PFCM could be a sintered material, a granular material, a fibrous material, or a foamed material.

The operation of the PFCM can cause either a gradual adjustment of the resistance to flow of the dispensed beverage, or a discrete, stepwise adjustment of the resistance to flow of the beverage during dispensing.

As discussed with respect to, for example, the first embodiment, the PFCM can be manually adjusted by a user to control the rate of flow of the beverage during dispensing. Alternatively, the PFCM can be adjusted automatically due to the change in pressure inside the container as the beverage is dispensed, as discussed for example with respect to the second embodiment. In the case of automatic adjustment, the level of resistance caused by the PFCM is automatically adjusted to be directly proportional to the level of pressure in the container, whereby the beverage can be dispensed at a substantially constant rate, regardless of a change in the pressure inside the container.

The dispenser assembly further comprises a valve, movable between an open, dispensing position that allows the beverage to be dispensed and a closed, non-dispensing position that prevents the beverage from being dispensed. When in the dispensing position, the valve allows the beverage to flow through the flow passage and the PFCM to be dispensed. When in the non-dispensing position, the valve provides a gas- and liquid-tight seal that effectively maintains the pressure within the container. The valve may be integral with the flow control member, or may be one or more separate elements. Further, the valve may be movable in association with the flow control member, such that both the valve and the PFCM are controlled by the same mechanism or actuator. Alternatively, the valve and the PFCM may be operated independently of one another by separate mechanisms or actuators.

Still further, the dispenser assembly comprises a discharge spout that directs the flow of discharged beverage, a dip tube attached to the dispenser body and extending inside the container to supply the liquid to be discharged to the dispenser body, and an attachment portion for attaching the dispenser assembly to the container. The attachment portion may be any suitable means of attachment such as, for example, screw threads, snap fit, adhesive, collet seal, thermo-sealing, friction welding, or the like. Accordingly, the dispenser body may be removably attached to, fixedly attached to, or formed integrally with the container by the attachment portion.

The dispenser may include additional flow regulating or restricting components. One such component is a conical-type valve assembly, in which one or more tapered or conical valve members are used to regulate a fluid flow rate by varying the size of a long restrictive flow path, as described in greater detail in U.S. patent application Publication No. 2005/0211736, filed Mar. 16, 2005, and entitled Dispenser Having a Conical Valve Assembly, which is incorporated herein by reference. Another flow regulating component is a long tube-type assembly, in which a long narrow tube is used to restrict and/or regulate the fluid flow rate using the head loss over the length of the tube, as described in greater detail in U.S. patent application Publication No. 2005/0252936, filed Mar. 16, 2005, and entitled Dispenser Mechanism Using Long Tubes to Vary Pressure Drop, which is also incorporated herein by reference. Each of the flow regulating and/or restricting features disclosed in either of the above-noted applications, can be used in combination with the embodiments disclosed herein. For example, it is envisioned that a dispenser might advantageously include any combination of one or more of a porous flow control member, a long tube, and a conical valve assembly. In one preferred combination, a dispenser might include a porous flow control member or long tube serving as a fixed (i.e., non-variable) flow restrictor with a conical valve assembly serving as an adjustable flow regulator.

First Embodiment

Figure 1A:
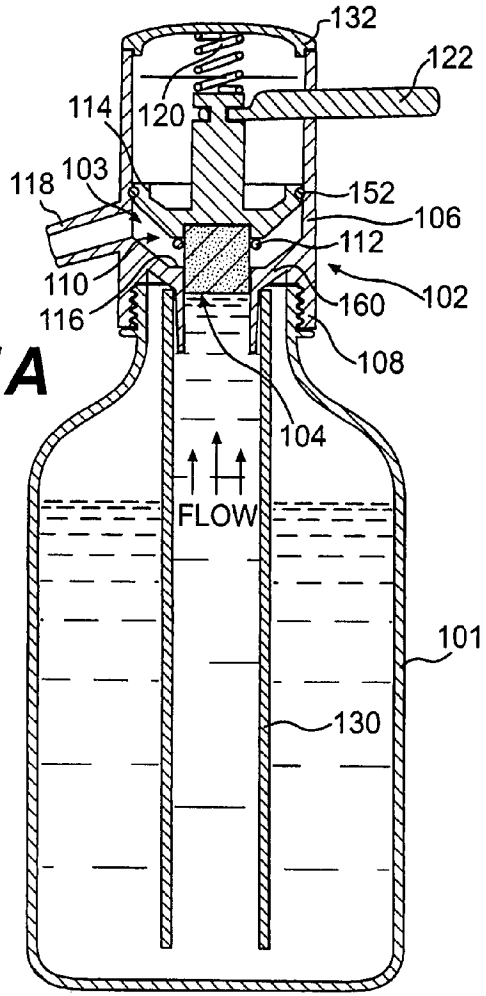
FIG. 1A is a section view showing a first embodiment of the dispenser assembly of the present invention in an open, dispensing state.

In a first embodiment of the present invention, illustrated in FIGS. 1A and 1B, the dispenser assembly 102 generally comprises a substantially cylindrical housing 106 for attachment to a container 101, a dispenser body 160 defining a flow passage 103, a PFCM 104 disposed in the flow passage 103, a dip tube 130, a valve 110, and an actuator 122. The dispenser assembly 102 of the first embodiment is operated by a simple manual turn of the actuator 122, whereby a user can easily control the rate of dispensing the beverage by a single motion.

In this embodiment, the dispenser body 160 is formed integrally with the housing 106 of the dispenser assembly 102. A cap 132 is provided to enclose the working parts in the housing 106. The flow passage 103 is defined in the dispenser body 160 for flow of the beverage out of the container 101 during dispensing. A discharge spout 118 for directing the beverage once it has passed through the flow passage 103 is provided in the side of the housing 106. The dispenser body 160 is removably attached to the container 101 by an integral threaded attachment portion 108. The dip tube 130 is attached to the dispenser body 160 at the lower portion of the flow passage 103 to supply the beverage from the container 101 to the dispenser assembly 102 for dispensing.

The PFCM 104 in this embodiment is constructed as a rigid, elongated cylinder and is disposed in the flow passage 103. The flow passage 103 is sized to accommodate the PFCM 104 and substantially seals around the circumference thereof, such that the beverage cannot circumvent the PFCM 104 and must pass through at least a portion of the length of the PFCM 104 before being dispensed. The PFCM 104 is arranged such that it is longitudinally slidable within the flow passage 103 in response to adjustment of the actuator 122. The PFCM 104 is preferably made of ceramic, metal, glass, plastic, organic material, a polymer, or a composite thereof, and is preferably manufactured by a sintering process. However, the method of manufacturing the PFCM 104 is not limited to sintering, and the PFCM 104 could also be made by, for example, molding, extruding, casting, weaving, machining, polishing, other suitable manufacturing methods, or any combination thereof.

As shown in FIG. 1A, the valve 110 includes an inner seal 112, a support plate 114, a valve seat 116, and a peripheral seal 152. The PFCM 104 is fixedly secured to the lower surface of the support plate 114, and the actuator 122 is rotatably secured to an upwardly extending stem 134 of support plate 114. Thus, movement of the actuator 122 by the user causes corresponding movement of the PFCM 104. The peripheral seal 152 is provided about the circumference of the support plate 114 to prevent communication of the beverage to the upper portion of the housing 106 during dispensing. The inner seal 112 is provided on the lower surface of the support plate 114 about the circumference of the PFCM 104. The valve seat 116 is a flat surface defined on the dispenser body 160 at the upper portion of the flow passage 103, for sealing engagement with the inner seal 112.

As shown in FIGS. 1A and 1B, the actuator 122 takes the form of a manual lever that extends through a sloped slot 128 formed in the side of the housing 106. When the actuator 122 is rotated in a circumferential direction of the housing 106, the sloped slot 128 causes the actuator 122 to also move in the axial direction of the housing 106 by a camming action. Since the actuator is rotatably connected to the support plate 114, the circumferential and axial motion of the actuator does not cause the support plate 114 to rotate, but it does force support plate 144 and the PFCM 104 to move in the axial direction of the cap 132 (i.e., vertically and in the longitudinal direction of the PFCM 104). A return spring 120 biases the actuator 122 in a clockwise direction, toward the closed, non-dispensing position (left in FIG. 1B), so as to maintain the valve 110 in a closed, non-dispensing position.

In operation, when a user desires to dispense beverage from the container 101, the user simply moves the actuator 122 in the counterclockwise direction, such as to the position shown in FIGS. 1A and 1B. This circumferential motion of the actuator 122 causes the actuator 122, and consequently the support plate 114 and the inner seal 112, to move axially upward in FIG. 1A, so that the beverage is allowed to flow through the PFCM 104 and out of the discharge spout 118. When the actuator is moved only a small distance in the counter clockwise direction the beverage will have to pass through substantially the entire effective length of the PFCM 104, thus providing considerable resistance to the flow of the beverage. As the actuator 122 is moved further in the counter clockwise direction, the PFCM 104 will be moved further up in FIG. 1A. The beverage will follow the path of least resistance and will, therefore, flow up from the lower end of the PFCM 104 and out the side (i.e., circumferential surface) of the PFCM 104 into the annular space surrounding the PFCM 104. Accordingly, the beverage will have to pass through a smaller portion of the length of the PFCM 104, thus reducing the amount of resistance to the flow of the beverage. If the user wishes to increase the rate of dispensation, the user has but to turn the actuator 122 further in the counterclockwise direction, thereby further reducing the resistance and increasing the rate of dispensation. When the user is finished dispensing the beverage, the user simply releases the actuator 122, and return spring 120 returns the actuator 122 and the valve 110 to a closed position, wherein the inner seal 112 abuts the valve seat 116 to provide a fluid- and gas-tight closure. As the beverage and hence the pressure in the container 101 becomes depleted, the user simply rotates the actuator 122 further until the desired flow rate is achieved. The desired flow rate may be determined either by observation or "feel," or the dispenser assembly may include an indicator specifying the proper actuator position for the current pressure in the container 101.

Second Embodiment

Figure 2:
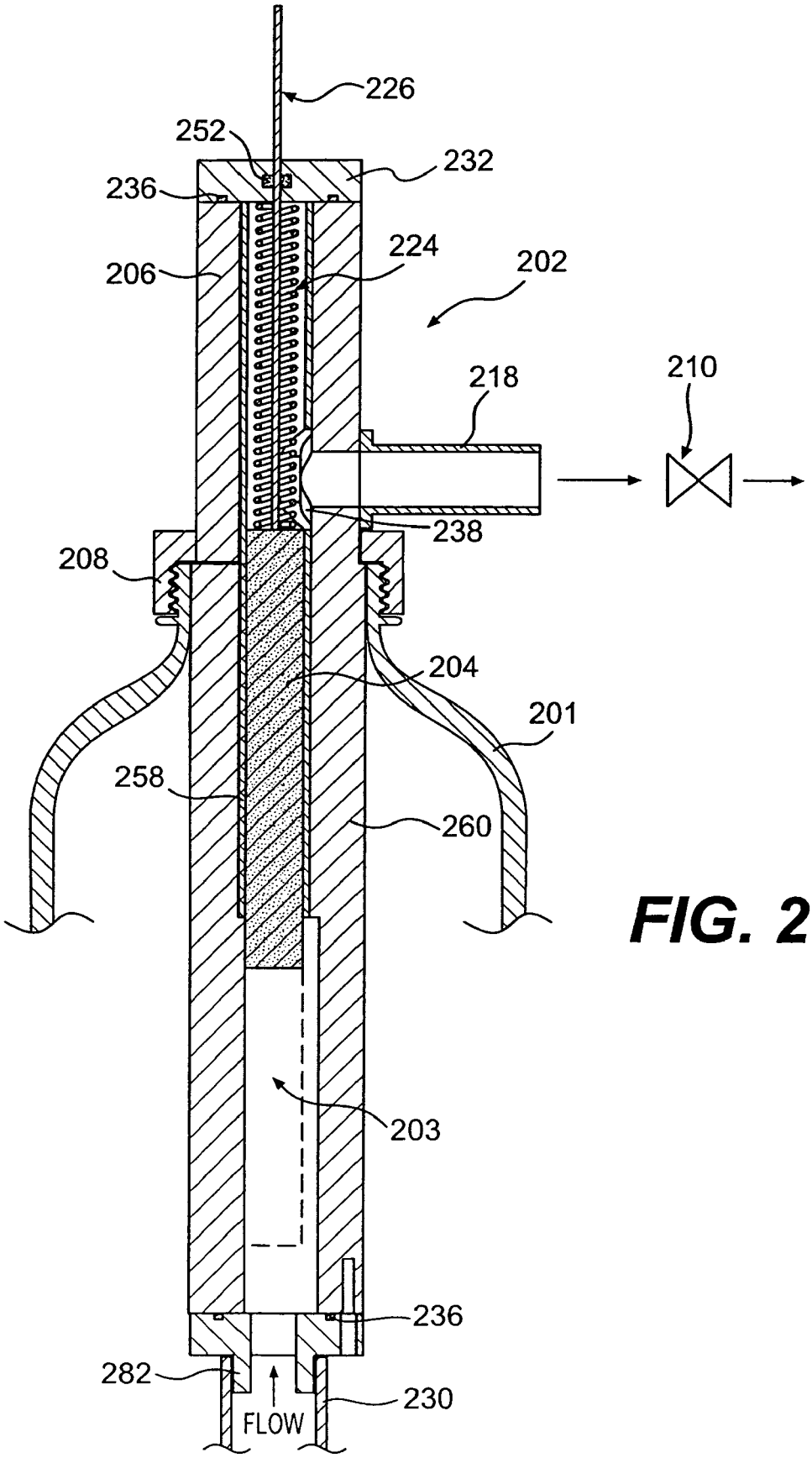
FIG. 2 is a partial, section view showing a second embodiment of the dispenser assembly of the present invention in an open, dispensing state.

The dispenser assembly 202 of the second embodiment of the invention functions on similar principles as the first embodiment, in that it uses the pressure contained in a beverage itself to propel the beverage from the container 201, and employs a PFCM 204 to vary the resistance to flow of a beverage during dispensing. However, in the second embodiment, the amount of resistance to flow of the beverage is adjusted automatically, rather than manually as in the first embodiment. That is, the user manually turns the dispenser assembly on and off, but does not have to control the rate at which the beverage is dispensed, this rate being adjusted automatically. As shown in FIG. 2, the dispenser assembly 202 generally comprises a substantially cylindrical housing 206, a dispenser body 260 defining a flow passage 203, a PFCM 204 disposed in the flow passage 203, a dip tube 230, and a valve 210.

As in the first embodiment, the dispenser body 260 is formed integrally with the substantially cylindrical housing 206. The housing 206 has a separate cap 232 that includes cap seal 236, which prevents the beverage from escaping through the top of the housing 206. The cap 232 may be fixedly or removably attached to the housing by any suitable attachment method, such as, for example, screw threads, snap fit, adhesive, collet seal, thermo-sealing, friction welding, or the like. A PFCM seal 258 is disposed within the dispenser body to seal against the outer periphery of the PFCM 204, to prevent the beverage from circumventing the PFCM 204 during dispensing. The dip tube 230 is attached to the dispenser body 260 at an inlet 282, which is located at the lower end of the flow passage 203, to supply the contained beverage to the dispenser assembly 202 for dispensing. In this embodiment, the dispenser body 260 is removably attached to the container 201 by a separate threaded attachment portion 208.

The PFCM 204 in this embodiment is constructed as a rigid, elongated cylinder and is disposed in the flow passage 203. An upper portion of the flow passage 203 is sized to closely surround the PFCM 204 and is lined with the PFCM seal 258, such that the beverage cannot circumvent the PFCM 204 and must pass through at least a portion of the length of the PFCM 204 before being dispensed. A lower portion of the flow passage 203 is formed slightly larger than the PFCM 204 so that the beverage can flow around the circumference of the PFCM 204 in the lower portion of the flow passage 203. The PFCM 204 is arranged such that it is longitudinally slidable within the flow passage 203 in accordance with the pressure in the container. The PFCM 204 of this embodiment is preferably manufactured by one or more of the manufacturing methods disclosed above with respect to the first embodiment. A regulating spring 224 is provided in the housing 206 to bias the PFCM 204 downward against the pressure and flow of the beverage out of the bottle. A guide member 226 is secured to the top of the PFCM 204 to hold the regulating spring 224 in position and to align the PFCM 204 within the flow passage 203. The guide member 226 extends through an aperture in the cap 232, and a guide seal 252 is provided between the guide member 226 and the cap 232 to prevent the beverage from escaping through the aperture in the top of the cap 232 during dispensing.

In this embodiment, as schematically shown in FIG. 2, a separate valve 210, which can be remote from the housing 206, is used to turn the dispenser assembly 202 on and off. However, the valve 210 could alternatively be made integrally with the housing 206. The valve 210 in this embodiment has only two positions, fully open and fully closed, and may be actuated by any conventional type of actuator, such as, for example, a lever, a push button, a knob, or the like.

When the valve 210 is closed, the pressure on both sides of the PFCM 204 will be allowed to equalize and the regulating spring 224 will bias the PFCM downward to the position shown in dashed lines in FIG. 2. When the valve 210 is opened, the beverage will begin to flow upward through the PFCM 204 toward the outlet spout 218. This upward flow of the beverage through the PFCM 204 will cause a pressure drop across the PFCM 204 and force the PFCM 204 up into the smaller, upper portion of the flow passage 203. This will increase the length of the PFCM 204 through which the beverage must pass and the resistance to flow of the beverage and, thereby regulate the rate at which the beverage is dispensed. The distance that the PFCM 204 will be forced up into the smaller, upper portion of the flow passage 203 depends on the amount of pressure in the container 201. When the container 201 is full of beverage, the pressure in the container 201 will be high and the PFCM 204 will be forced almost completely into the smaller, upper portion of the flow passage 203 until it reaches a stop member 238, as shown in FIG. 2. If the container 201 is less than full, the pressure in the container will be less and, thus, the PFCM 204 will be forced only partially into the smaller, upper portion of the flow passage 203.

Thus, when a user wishes to dispense beverage from the container 201, the user simply opens valve 210 to the fully open position. As soon as the beverage begins to flow through the flow passage 203, the PFCM 204 will be automatically pushed up into the smaller, upper portion of the flow passage 203 to the appropriate level to regulate the resistance to flow and to maintain a substantially constant, steady rate of dispensation. This ensures that the flow rate of the beverage and the amount of carbonation in the dispensed beverage will be substantially constant, until the container is completely depleted.

Third Embodiment

Figure 3:
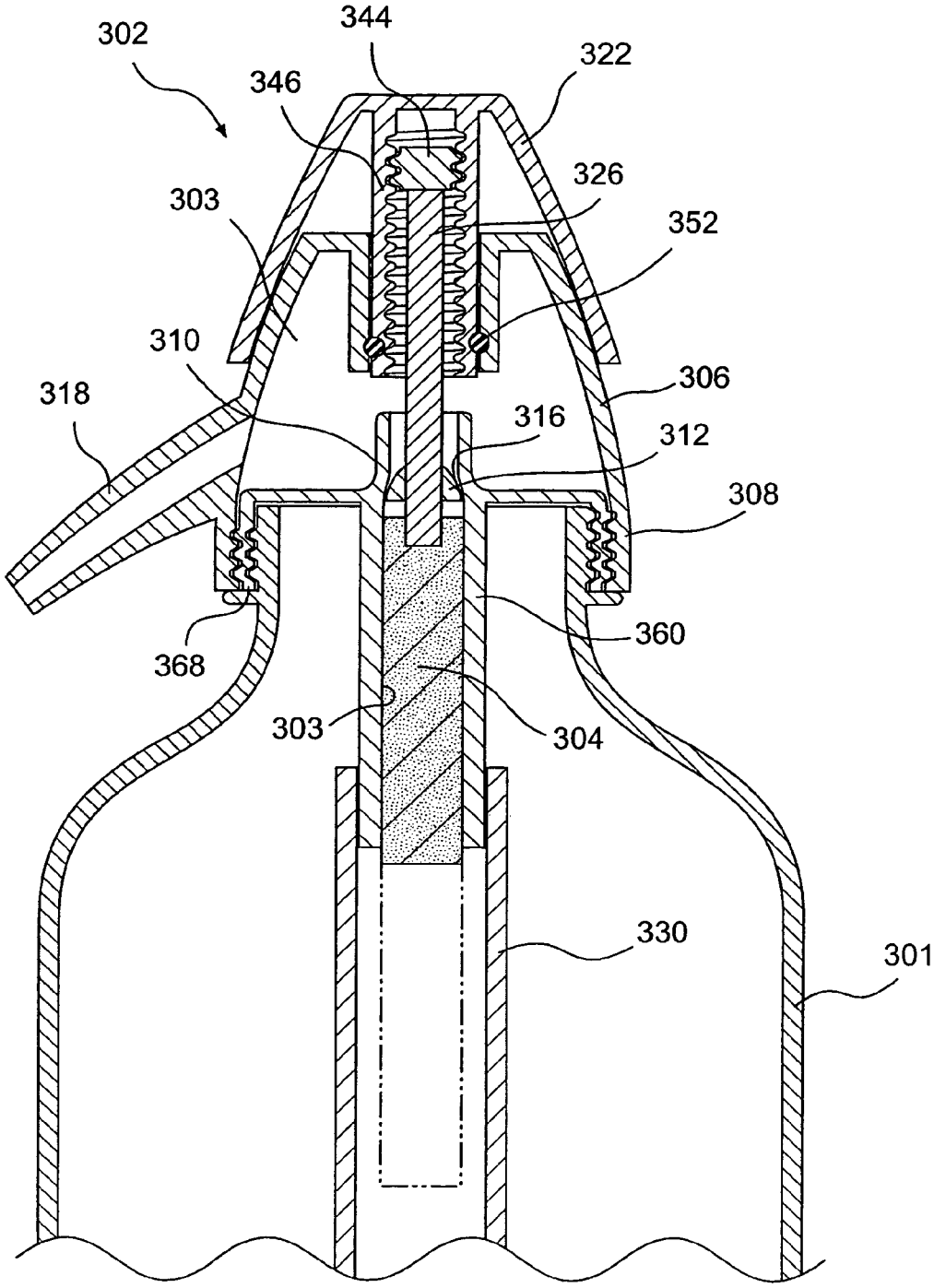
FIG. 3 is a partial, section view showing a third embodiment of the dispenser assembly of the present invention in a closed, non-dispensing state.

The third embodiment, shown in FIG. 3, is a manually actuated dispenser assembly 302, similar in operation to the first embodiment in many respects. However, the third embodiment differs from the first embodiment at least in the arrangement of the dispenser body 360, actuator 322, valve 310, and attachment portion 308.

The dispenser assembly 302 of the third embodiment generally comprises a housing 306, a dispenser body 360 defining a flow passage 303, a PFCM 304 disposed in the flow passage 303, a dip tube 330, a valve 310, and an actuator 322. The dispenser assembly 302 of the third embodiment is operated by twisting the actuator 322, whereby a user can easily control the rate of dispensing the beverage by a single actuator.

In this embodiment, the dispenser body 360 can be formed separately from the dome-shaped housing 306. A flow passage 303 is defined in the dispenser body 360 for flow of the beverage out of the container 301 during dispensing. A discharge spout 318 for directing the beverage once it has passed through the flow passage 303 is provided in the side of the housing 306. The dispenser body 360 is secured to the container 301 by a collet seal attachment portion 308 of the housing, such that an outer peripheral portion 368 of the dispenser body 360 is sandwiched between the neck of the container 301 and a collet attachment portion 308 of the housing 306. The dip tube 330 is attached to the dispenser body 360 at the lower portion of the flow passage 303 to supply the beverage to the dispenser assembly 302 for dispensing.

The PFCM 304 in this embodiment is constructed as a rigid, elongated cylinder and is disposed in the flow passage 303. The flow passage 303 is sized to accommodate the PFCM 304 and substantially seals around the circumference thereof, such that the beverage cannot circumvent the PFCM 304 and must pass through at least a portion of the length of the PFCM 304 before being dispensed. The PFCM 304 is interconnected to the actuator 322 by a guide member 326, such that the PFCM 304 is longitudinally slidable within the flow passage 303 in response to adjustment of the actuator 322 by a user. The PFCM 304 of this embodiment is preferably manufactured by one or more of the manufacturing methods disclosed above with respect to the first embodiment.

The valve 310 of the third embodiment includes a valve body 312 and a valve seat 316, against which the valve body 312 abuts to seal the flow passage 303 when the actuator 322 is in the closed position. The valve body 312 is movably supported by the guide member 326, such that the guide member 326 moves the valve body 312 into abutment with the valve seat 316 when the actuator is adjusted to the closed position.

The actuator 322 in this embodiment takes the form of a knob, which can be turned to open and close the valve 310 and to adjust the resistance to flow of the beverage during dispensing. In particular, the actuator 322 has a center channel 346 which extends into the top of the housing 306 and is sealed to the housing 306 by an actuator seal 352. The inner surface of the center channel 346 of the actuator 322 is threaded for engagement with a threaded portion 344 of the guide member 326. Thus, when the actuator 322 is turned, the threads of the center channel 346 engage the threaded portion 344 of the guide member 326, thereby driving the guide member 326, and consequently the valve body 312 and the PFCM 304, in the axial direction.

FIG. 3 shows the dispenser assembly 302 of the third embodiment in the closed, non-dispensing state. In operation, when a user wishes to dispense the beverage, the user merely turns the actuator 322 in a counterclockwise direction. This turning motion of the actuator 322 causes the guide member 326 to be driven axially downward, thus moving valve body 312 away from the valve seat 316 and opening valve 310. If the actuator 322 is turned only a small degree, the PFCM 304 will still be substantially enclosed in the lower portion of the flow passage 303 and the beverage will have to pass through substantially the whole length of the PFCM 304 to be dispensed, thus providing significant resistance to flow of the beverage. As the user turns the actuator 322 a greater degree, the PFCM 304 will be driven axially downward and out of the flow passage and the resistance to flow of the beverage will be correspondingly reduced.

Due to the fact that it does not include a return spring or other metal components, this embodiment may be recycled even more easily than the foregoing embodiments.

Fourth Embodiment

Figure 4:
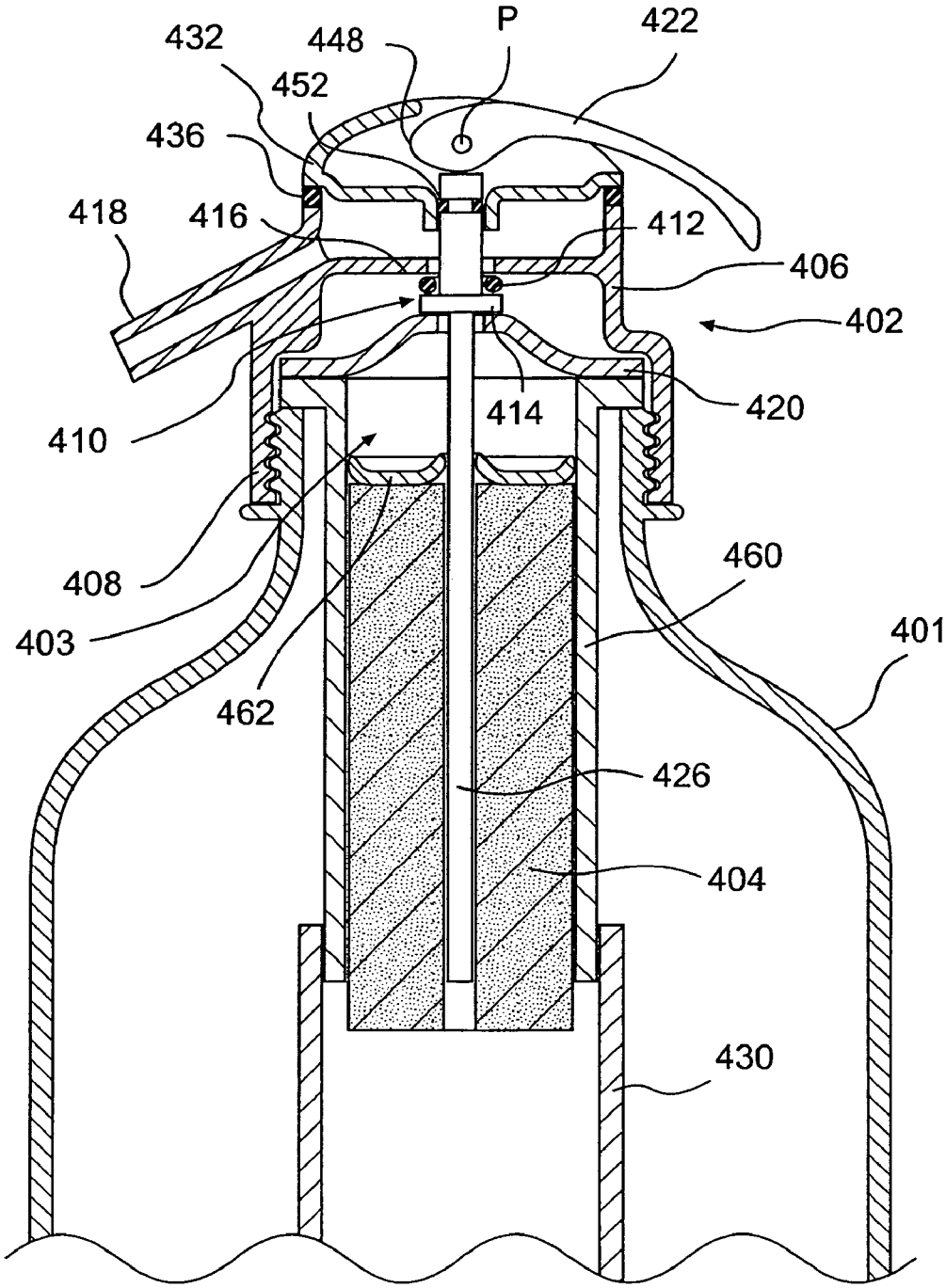
FIG. 4 is a partial, section view showing a fourth embodiment of the dispenser assembly of the present invention in a closed, non-dispensing state.

The fourth embodiment, shown in FIG. 4, is a manually actuated dispenser assembly having a one-way ratcheting adjustment. The dispenser assembly 402 of the fourth embodiment generally comprises a housing 406, a dispenser body 460 defining a flow passage 403, a PFCM 404 disposed in the flow passage 403, a dip tube 430, a valve 410, and an actuator 422. The dispenser assembly 402 of the fourth embodiment is operated by lifting the actuator 422, whereby a user can easily adjust the rate of dispensing the beverage by a single actuator.

As shown in FIG. 4, the dispenser body 460 can be formed separately from the housing 406. A separate cap 432 is sealed to the top of the housing 406 and prevents the beverage from escaping from the top of the housing 406 during dispensing of the beverage. The cap 432 is further provided with an aperture through which a guide member 426 extends for movement of the PFCM 404 in accordance with movement of the actuator 422. The aperture in the cap 432 has an actuator seal 452 disposed therein to provide a seal between the cap 432 and the guide member 426 to prevent the beverage from escaping through the aperture during dispensing. The flow passage 403 is defined in the dispenser body 460 for flow of the beverage out of the container 401 during dispensing. A discharge spout 418 for directing the beverage once it has passed through the flow passage 403 is provided in the side of the housing 406. The dispenser body 460 is held in place by the housing 406. Specifically, an annular flange portion of the dispenser body 460 is clamped in place as the housing 406 is secured to threads of container 401 by threaded attachment portion 408 of the housing 406. The dip tube 430 is attached to the dispenser body 460 at the lower portion of the flow passage 403 to supply the beverage to the dispenser assembly 402 for dispensing.

The PFCM 404 in this embodiment is constructed as a rigid, elongated cylinder and is disposed in the flow passage 403. The flow passage 403 is sized to accommodate the PFCM 404 and substantially seals around the circumference thereof, such that the beverage cannot circumvent the PFCM 404 and must pass through at least a portion of the length of the PFCM 4040 before being dispensed. The guide member 426 extends at least partially through the PFCM 404 and is slidable relative to the PFCM 404. The PFCM 404 of this embodiment is preferably manufactured by one or more of the manufacturing methods disclosed above with respect to the first embodiment. A one-way slide washer 462 is positioned at the top of the PFCM 404, such that the guide member 426 can freely slide relative to the one-way slide washer 462 in the upward direction, but not in the downward direction. Accordingly, if the guide member 426 is moved downward while pushing the PFCM 404 ahead of it. The one-way slide washer 462 has a plurality of fluid paths (not shown) that allow the beverage to flow past the one-way slide washer 462 without resistance.

The valve 410 in this embodiment, includes a seal member 412, as support plate 414 attached to the guide member 426, and a valve seat 416 against which the seal member 412 abuts. A return spring 420 biases the support plate 414, and hence the guide member 426 and seal member 412, upward toward the valve seat 416, so as to maintain the valve 410 in a closed, non-dispensing position. When the guide member 426 is forced downward by the non-dispensing position. When the guide member 426 is forced downward by the actuator 422, the return spring 420 is compressed by the support plate 414 and the seal member 412 is moved away from valve seat 416 to open valve 410 to dispense the beverage.

The actuator 422 in this embodiment is a lever with a cam surface 448 at the pivot end thereof. In operation, when a user desires to dispense the beverage, the user merely lifts the actuator 422. When the actuator is lifted slightly, it pivots about point P, rotating the lower cam surface 448 of the actuator 422 into engagement with the upper end of the guide member 426 and forcing the guide member 426 downward, thus opening valve 410 for dispensing of the beverage. As the guide member 426 is forced downward, the one-way slide washer 462 is also forced downward pushing the PFCM 404 ahead of it. After this first movement of the actuator, the PFCM 404 has only moved slightly downward, and the beverage must pass through substantially the entire length of the PFCM 404 before being dispensed. As the actuator is lifted to its completely raised position, the PFCM 404 is forced further down and the resistance to flow of the beverage is correspondingly reduced. If the user desires to further reduce the resistance to flow of the beverage, such as when the volume of beverage in the container 401 becomes low, the user simply lowers the actuator 422 and raises it again. When the actuator 422 is lowered, the return spring 420 biases the guide member 426 and the seal member 412 upward to close the valve 410; however, the one-way washer 462 is not allowed to move upward, so the one-way washer 462 and the PFCM 404 are maintained in the new lower position. When the actuator 422 is again lifted, the valve 410 will again be opened and the PFCM 404 will again be forced downward by the one-way washer 462. In this manner the resistance to flow of the beverage during dispensing can be incrementally reduced each time the actuator 422 is lifted.

Fifth Embodiment

Figure 5:
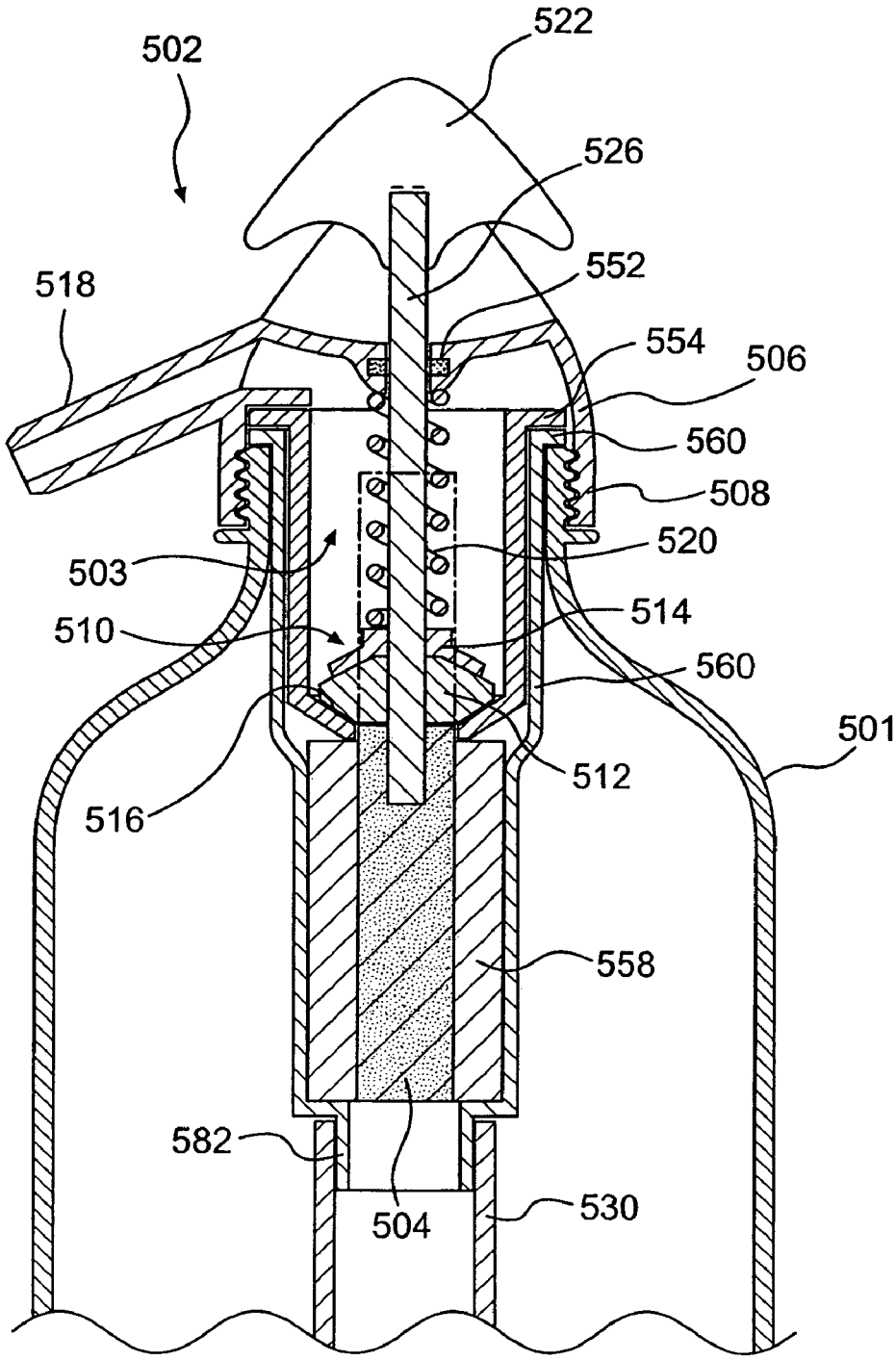
FIG. 5 is a partial, section view showing a fifth embodiment of the dispenser assembly of the present invention in a closed, non-dispensing state.

The fifth embodiment, shown in FIG. 5, is a manually actuated dispenser assembly having a pull-open style actuator 522. The dispenser assembly 502 of the fifth embodiment generally comprises a housing 506, a dispenser body 560 defining a flow passage 503, a PFCM 504 disposed in the flow passage 503, a dip tube 530, a valve 510, and an actuator 522. The dispenser assembly 502 of the fifth embodiment is operated by pulling the actuator 522, whereby a user can easily control the rate at which the beverage is dispensed using a single actuator.

In the fifth embodiment, the dispenser body 560 can be formed separately from the housing 506. The housing 506 has an aperture in the top through which a guide member 526 extends for actuation of the valve 510 and adjustment of the PFCM 504, in accordance with movement of the actuator 522. The aperture in the housing is provided with an actuator seal 552 to provide a seal between the housing 506 and the guide member 526 to prevent the beverage from escaping through the aperture during dispensing. The flow passage 503 is defined in the dispenser body 560 for flow of the beverage out of the container 501 during dispensing. A discharge spout 518 for directing the beverage once it has passed through the flow passage 503 is provided in the side of the housing 506. A liner 554 is disposed inside the flow passage 503 of the dispenser body 560. Both the dispenser body 560 and the liner 554 are held in place by the housing 506. In particular, annular flange portions of the dispenser body 560 and the liner 554 are clamped in place as the housing 506 is secured to the neck of the container 501 by threaded attachment portion 508 of the housing 506. The dip tube 530 is attached to the dispenser body 560 at an inlet 582, which is located at the lower portion of the flow passage 503, to supply the beverage to the dispenser assembly 502 for dispensing.

The PFCM 504 in this embodiment is constructed as a rigid, elongated cylinder and is disposed in the flow passage 503. The PFCM 504 is attached to the lower end of the guide member 526. The PFCM 504 of this embodiment is preferably manufactured by one or more of the manufacturing methods disclosed above with respect to the first embodiment. A PFCM seal 558 is fitted inside the lower portion of the flow passage 503 and is sized to accommodate the PFCM 504 and substantially seal around the circumference thereof, such that the beverage cannot circumvent the PFCM 504 and must pass through at least a portion of the length of the PFCM 504 before being dispensed. The PFCM seal 558 should be made of a low friction material that provides a good seal with the PFCM 504, preferably either a foam or elastomer material. Other materials may also be used for the PFCM seal 558, so long as they adequately seal against the outer surface of the PFCM 504.

The valve 510 includes a seal member 512, a support plate 514, and a valve seat 516. The seal member 512, the support plate 514, and a return spring 520 are disposed sequentially above the PFCM 504 on the guide member 526. FIG. 5 shows the dispenser assembly 502 in the closed, non-dispensing position, with the seal member 512 abutted against the valve seat 516.

In this embodiment, the actuator 522 is simply a handle attached to the end of the guide member 526. To begin dispensing the beverage, a user has only to pull up on the actuator 522, thereby compressing return spring 520 and separating the seal member 512 from the valve seat 516 and opening valve 510. As soon as the valve 510 is opened, the beverage begins to flow up through the flow passage 503. When the actuator is only pulled up a short distance, the PFCM 504 is still substantially enclosed by the PFCM seal 558 and the beverage must pass through substantially the entire length of the PFCM 504 before being dispensed, thus providing substantial resistance to flow of the beverage. As the actuator is pulled further from the housing 506, the PFCM 504 is moved up toward the position shown in dashed lines in FIG. 5, thereby reducing the length of the PFCM 504 through which the beverage must flow and, consequently, reducing the resistance to flow of the beverage. Upon release, the actuator 522 is returned to the closed, non-dispensing position by the return spring 520.

Sixth Embodiment

Figure 6A:
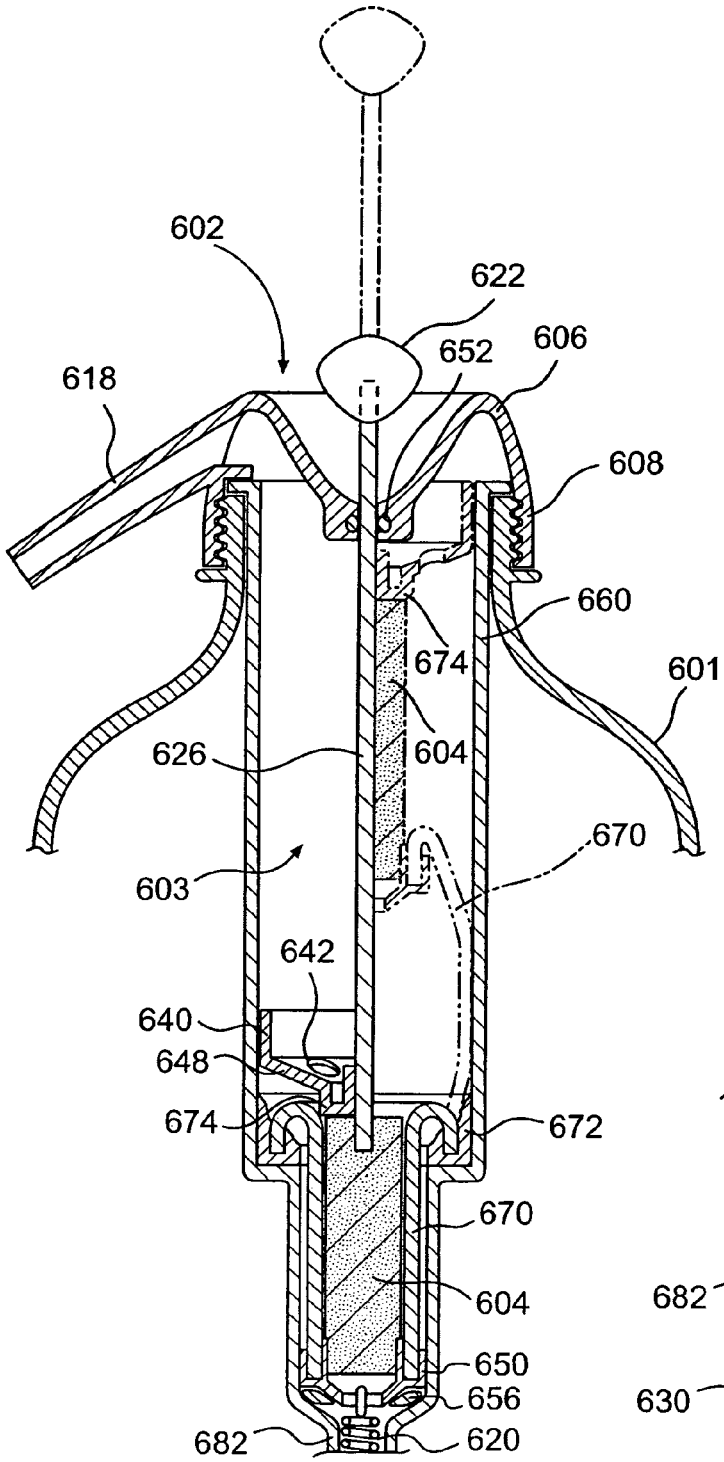
FIG. 6A is a partial, section view showing a sixth embodiment of the dispenser assembly of the present invention in a closed, non-dispensing state.
Figure 6B:
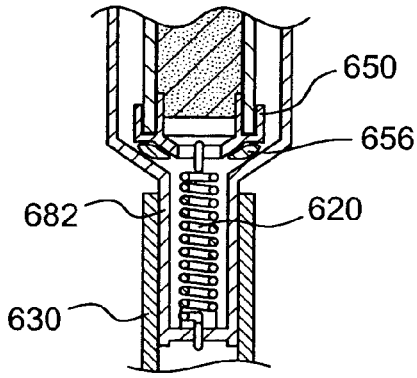
FIG. 6B is a partial, enlarged, section view of the sixth embodiment of the dispenser assembly of FIG. 6A.

The sixth embodiment, shown in FIGS. 6A and 6B, is a manually actuated dispenser assembly having a rolling diaphragm seal and a pull-type actuator. The dispenser assembly 602 of the sixth embodiment generally comprises a housing 606, a dispenser body 660 defining a flow passage 603, a PFCM 604 disposed in the flow passage 603, a diaphragm seal 670 for adjusting the flow through the PFCM 604, a dip tube 630, and an actuator 622. The dispenser assembly 602 of the sixth embodiment is operated by pulling the actuator 622, whereby a user can easily control the rate of the dispensing beverage.

In the sixth embodiment, the dispenser body 660 can be formed separately from the housing 606. The housing 606 has an aperture in the top, through which a guide member 626 extends, for adjustment of the PFCM 604 in accordance with movement of the actuator 622. The aperture in the housing is provided with an actuator seal 652 to seal between the housing 606 and the guide member 626 to prevent the beverage from escaping through the aperture during dispensing. A flow passage 603 is defined in the dispenser body 660 for flow of the beverage out of the container 601 during dispensing. A discharge spout 618 for directing the beverage once it has passed through the flow passage 603 is provided in the side of the housing 606. The dispenser body 660 is held in place by the housing 606. Specifically, an annular flange portion of the dispenser body 660 is clamped in place as the housing 606 is secured to the neck of the container 601 by threaded attachment portion 608 of the housing 606. The dip tube 630 is attached to the dispenser body 660 at an inlet 682, which is located at the lower portion of the flow passage 603, to supply the beverage to the dispenser assembly 602 for dispensing.

The PFCM 604 in this embodiment is constructed as a rigid, elongated cylinder and is disposed in the flow passage 603. The PFCM 604 of this embodiment is preferably manufactured by one or more of the manufacturing methods disclosed above with respect to the first embodiment. The rolling diaphragm seal 670 is disposed in the flow passage 603 such that it envelops the PFCM 604 and seals around the circumference thereof. The beverage cannot circumvent the PFCM 604 and must pass through at least a portion of the length of the PFCM 604 before being dispensed. Specifically, the diaphragm seal 670 is attached to the bottom portion of the PFCM 604 at a stop mount 650, and is attached to the dispenser body at a seal anchor 672. The PFCM 604 is attached to the lower end of the guide member 626 and is movable therewith. Bump-stops 656 are affixed to the bottom of the stop mount 650, and serve to center the lower end of the PFCM 604 above the inlet 682 of the dispenser body 660 and limit the axial movement of the PFCM 604 in the downward direction. A stabilizer 640 is attached to the guide member 626 just above the PFCM 604 and slides along the inner surface of the dispenser body to center the PFCM 604 in the flow passage 603. The stabilizer 640 has a central beveled portion 648 with a plurality of fluid transmission holes 642 that facilitate flow of the beverage during dispensing, and a lower fluid blocking surface 674 that functions as a valve and prevents flow of the beverage when in the closed, non-dispensing position. As shown in FIG. 6B, a return spring 620 is attached to the bottom of the PFCM 604 to bias the PFCM 604 toward the lower, non-dispensing position.

In operation, to start dispensing the beverage from the container 601, a user has merely to pull up on the actuator 622. Initially, when the actuator is in the closed, non-discharge, position, as shown in solid lines in FIGS. 6A and 6B, the diaphragm seal 670 seals off the circumference of the PFCM 604 and the lower fluid blocking surface 674 of the stabilizer 640 prevents flow of the beverage through the upper axial end of the PFCM 604. When the actuator 622 is pulled up only slightly, the beverage is able to flow past the lower fluid blocking portion 674 of the stabilizer 640, but must pass through substantially the entire length of the PFCM 604 before being dispensed; thus, the flow of the beverage is substantially restricted. In order to increase the rate of dispensing, a user merely has to pull up further on the actuator 622. As the actuator 622 is pulled upward, the PFCM 604 is guided upward in the flow passage 603 and the diaphragm seal 670 begins to peel back away from the circumference of the flow control member 604. The diaphragm seal 670 should be made of a flexible, low friction material that provides a good seal with the PFCM 604, such as soft plastic, rubber, or other elastomeric materials. As the diaphragm seal 670 is gradually peeled back, the length of the PFCM 604 through which the beverage must pass before being dispensed is correspondingly decreased. Thus, when the actuator is pulled up to the position shown in dashed lines in FIG. 6A, the beverage only has to pass through a small portion of the PFCM 604; the restriction to flow of the beverage is thereby substantially eliminated. When the user releases the actuator 622, the return spring 620 returns the dispenser assembly 602 to the closed, non-dispensing position.

Seventh Embodiment

Figure 7B:
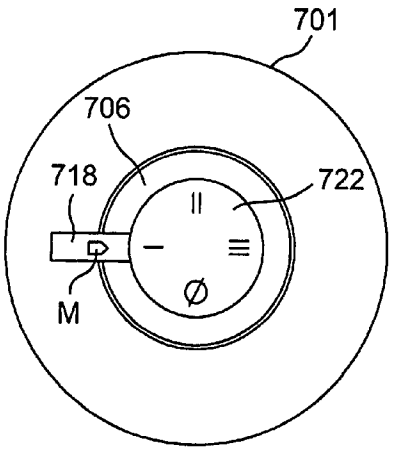
FIG. 7B is a top view of the seventh embodiment of the dispenser assembly in a low flow/high resistance setting.
Figure 7C:
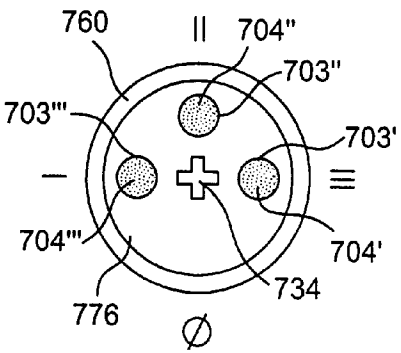
FIG. 7C is a top view of the dispenser body of the seventh embodiment of the present invention.
Figure 7A:
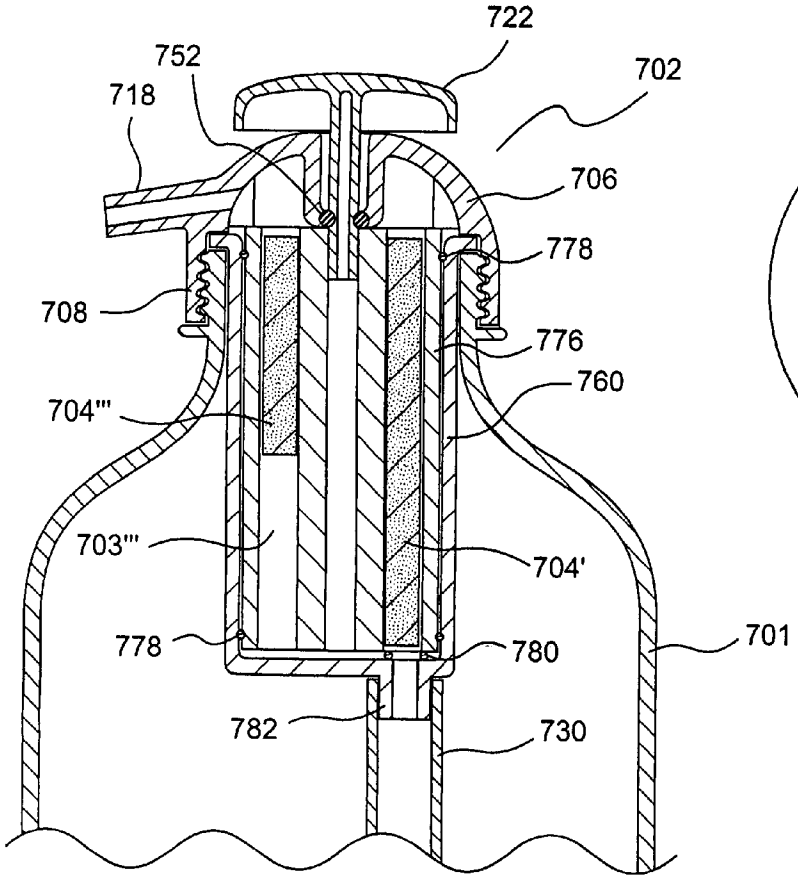
FIG. 7A is a partial, section view showing a seventh embodiment of the dispenser assembly of the present invention in a low flow/high resistance setting.

The seventh embodiment, shown in FIGS. 7A-7C, is a manually actuated dispenser assembly having a knob actuator for selecting one of a plurality of discrete dispensing settings. The dispenser assembly 702 of the seventh embodiment generally comprises a housing 706, a dispenser body 760 having a revolving cylinder 776 that defines a plurality of flow passages 703'-703''', a plurality of PFCMs 704'-704''' each disposed in a corresponding one of the flow passages 703'-703''', a dip tube 730, and an actuator 722. The dispenser assembly 702 of the seventh embodiment is operated by turning the actuator 722, whereby a user can easily select one of a plurality of predetermined dispensing settings by rotating the actuator 722.

In the seventh embodiment, the dispenser body 760 can be formed separately from the housing 706. The dispenser body 760 is disposed within the neck of the bottle 701 and includes the revolving cylinder 776 enclosed by the dispenser body 760. The revolving cylinder 776 is able to rotate relative to the rest of the dispenser body 760 and is sealed to the dispenser body 760 at its upper and lower ends by cylinder seals 778. The housing 706 has an aperture in the top, through which a guide member 726 extends for adjustment of the PFCM 704, in accordance with movement of the actuator 722. The aperture in the housing 706 is provided with an actuator seal 752 to seal between the housing 706 and the guide member 726 to prevent the beverage from escaping through the aperture during dispensing. A receptacle 734 is provided in the center of the revolving cylinder 776 for attachment to the lower end of the guide member 726. The plurality of flow passages 703'-703''' are defined in the revolving cylinder 776 of the dispenser body 760 for selective flow of the beverage out of the container 701 during dispensing. A selector seal 780 is provided to seal about the circumference of the selected one of the plurality of PFCMs 704'-704''', such that when one PFCM is selected by the actuator 722, the beverage is allowed to flow only through that particular PFCM during dispensing. A discharge spout 718 for directing the beverage once it has passed through one of the flow passages 703'-703''' is provided in the side of the housing 706. The dispenser body 760 is held in place by the housing 706, by an annular flange portion of the dispenser body 760 being clamped in place as the housing 706 is secured to the neck of the container 701 by threaded attachment portion 708 of the housing 706. The dip tube 730 is attached to the dispenser body 760 at an inlet 782, which is located at the lower end of the dispenser body 760.

Each of the PFCMs 704'-704''' of this embodiment is constructed as a rigid, elongated cylinder and is disposed in a respective one of the flow passages 703'-703'''. The PFCMs 704'-704''' of this embodiment are preferably manufactured by one or more of the manufacturing methods disclosed above with respect to the first embodiment. The flow passages 703'-703''' are sized to accommodate the PFCMs 704'-704''' and substantially seal around their circumferences, such that the beverage cannot circumvent the PFCMs 704'-704''' and must pass through the entire length of one of the PFCMs 704'-704''' before being dispensed. Preferably all of the PFCMs 704'-704''' have the same cylindrical diameter, but different lengths. However, it is also possible that the PFCMs 704'-704''' have different diameters, but the same length, or that each of the PFCMs 704'-704''' could be the same size and shape, but made of different materials having different resistances to flow of the beverage therethrough. Any of these three arrangements will assure that each of the PFCMs 704'-704''' causes a different resistance to flow of the beverage.

The actuator 722 in this embodiment is simply a knob that may be turned between multiple different flow resistance settings. As shown in FIG. 7B, the actuator 722 has indicia for four different flow resistance settings (i.e., ø, I, II, and III), with the ø setting indicating a closed, non-dispensing condition, the I setting indicating a low flow/high resistance condition, the II setting indicating a medium flow/medium resistance condition, and the III setting indicating a high flow/low resistance condition. As shown in FIGS. 7A-7C, the I setting of actuator 722 is set and the indicia of setting I is aligned with a marker M on the discharge spout 718. In this setting, the PFCM 704', the longest of the plurality of flow control members, is lined up with the inlet 782 of the dispenser body 760, and the beverage is forced to flow through the entire length of the PFCM 704' before being dispensed; thus, the resistance to flow of the beverage is high and the rate of flow is significantly restricted. In order to increase the rate of dispensing, the user merely turns the actuator 722 in the counterclockwise direction in FIG. 7B until the indicia for the II setting is aligned with the marker M on the discharge spout 718. This rotation of the actuator 722 causes the revolving cylinder 776 to rotate such that the PFCM 704'', which is shorter than the PFCM 704' but longer than the PFCM 704''', is aligned with the inlet 782 of the dispenser body 760. Further rotation of the actuator 722 to setting III will again reduce the resistance to flow of the beverage and increase the flow in the same manner, since this setting will align the PFCM 704''', the shortest of the PFCMs, with the inlet 782. In order to turn off the dispenser assembly 702 of this embodiment, the user simply turns the actuator 722 to align the indicia for the ø setting with the marker M. In the ø setting, no flow passage is aligned with the inlet 782 of the dispenser body and the selector seal 780 seals against the lower surface of the revolving cylinder 776 to effectively seal the container 701 in a closed, non-dispensing state.

While the markings ø, I, II, and III are used in FIGS. 7A-7C to indicate the different flow settings of the dispenser assembly 702, it will be understood that any appropriate markings, such as Arabic numerals, letters, words, symbols, pictures, or the like, could also be used to indicate the different flow settings.

While FIGS. 7A-7C depict the dispenser assembly 702 of the seventh embodiment as having four discrete flow settings, it will be understood that any number of flow settings could be used, and that any appropriate number of PFCMs and flow passages could be used to facilitate such variations.

In an alternative variation of the seventh embodiment, each of the PFCMs could be made the same length and the number of PFCMs through which fluid is allowed to flow could be made selectable to change the resistance to flow of the beverage during dispensing. That is, in a low flow setting, the beverage would be allowed to flow through only a single one of the PFCMs. In order to increase the flow rate of the beverage, the user would simply turn the actuator to a higher flow setting to allow the beverage to flow through two or more of the PFCMs in parallel, thereby reducing the resistance to flow of the beverage from the container (i.e., more PFCMs in parallel=less resistance). A similar result could also be achieved by arranging the PFCMs in series, except that in that case the resistance to flow would be directly proportional to the number of PFCMs arranged in series (i.e., more PFCMs in series=more resistance).

Eighth Embodiment

Figure 8A:
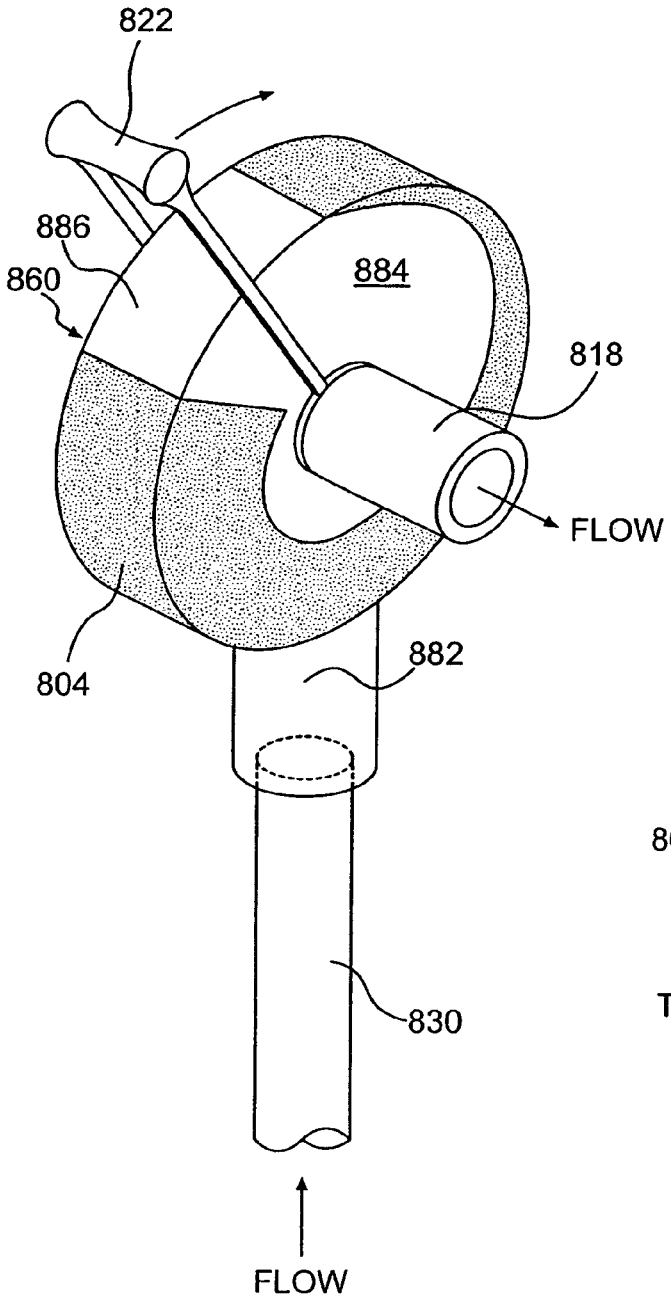
FIG. 8A is a perspective view showing a flow regulating portion of an eighth embodiment of the present invention.
Figure 8B:
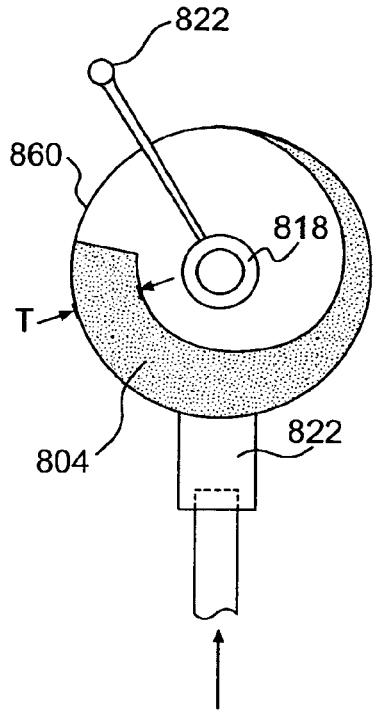
FIG. 8B is a side view showing the flow regulating portion of the eighth embodiment of the present invention.

In an eighth embodiment, shown in FIGS. 8A and 8B, a PFCM 804 and a dispenser body 860 together form a cylindrical disc shaped device. The PFCM 804 is constructed as a partial spiral- or nautilus-shaped piece of rigid porous material disposed about the outer edge of the dispenser body 860, and has a thickness T that varies over the length of the arc of the spiral. The PFCM 804 of this embodiment is preferably manufactured by one or more of the manufacturing methods disclosed above with respect to the first embodiment. It will be understood that the dispenser body 860 and the PFCM 804 of the eighth embodiment can be incorporated into a dispenser assembly similar to any one of the previous embodiments. Accordingly, only the dispenser body 860 and the PFCM 804 of the eighth embodiment have been illustrated for clarity.

In one possible version of the eighth embodiment, both the dispenser body 860 and the PFCM 804 are partitioned into radial (i.e., partial pie-shaped) sections (not shown), such that the beverage is allowed to flow through only one section of the PFCM 804 at a time. In this arrangement, each section of the PFCM 804 will have a different thickness T, and consequently, a different resistance to flow of the beverage. The actuator 822 is shown in FIGS. 8A and 8B in a medium setting, wherein the beverage is allowed to flow through a section of the PFCM 804 having a medium thickness, thus, providing a medium resistance to flow of the beverage. In order to decrease the resistance to flow of the beverage and thereby increase the rate of dispensing, a user simply moves the actuator 822 in the direction of the arrow in FIG. 8A to select a section of the PFCM 804 having a lesser thickness T. Conversely, to increase the resistance and decrease the rate of dispensation of the beverage, the user moves the actuator 822 in the direction opposite that of the arrow in FIG. 8A. This arrangement results in a dispenser with a discrete number of adjustments equal to the number of sections into which the PFCM 804 and the dispenser body 860 are partitioned.

Alternatively, in a second possible version of the eighth embodiment, the interior of the dispenser body 860, which is not shown in either FIG. 8A or 8B, may be formed as a single hollow cavity that is bounded on its ends by axial portions 884 of the dispenser body 860, and is bounded about its circumference by the PFCM 804 and a circumferential portion 886 of the dispenser body 860. In this case, the disc shaped cylinder formed by the dispenser body 860 and the PFCM 804 would be encased on all sides by a shell (not shown), such that the only openings in the shell would be located at the lower inlet 882 where dip tube 830 is attached and at an outlet tube 818. With this arrangement, during dispensation the beverage is allowed to permeate throughout substantially all of the PFCM 804 inside the shell, however the flow of the beverage through the PFCM 804 would be limited to that portion of the PFCM 804 located directly over the inlet 882. Thus, moving the actuator 822 will cause the thickness T of the PFCM 804 located over the inlet 882 to change to thereby vary the resistance to flow of the beverage during dispensing. This variation of the eighth embodiment is adjusted in substantially the same manner as the first variation discussed above, i.e., the flow increases when the actuator is moved in the direction of the arrow in FIG. 8A and decreases when moved in the opposite direction, except that an infinitely variable flow control is achieved. That is, an infinite number of different settings are available between the fully closed and fully open positions.

In order to completely stop dispensing of the beverage and to place the container in a non-dispensing state, the dispenser assembly of the eighth embodiment could include a separate valve 810 (not shown) or the circumferential portion 886 of the dispenser body 860 could serve as a sealing surface. That is, when the actuator 822 is moved to its limit in the direction opposite the arrow in FIG. 8A, the circumferential portion 886 would move into position above the inlet 882 and seal the inlet 882 to provide a closed, non-dispensing state.

Ninth Embodiment

Figure 9:
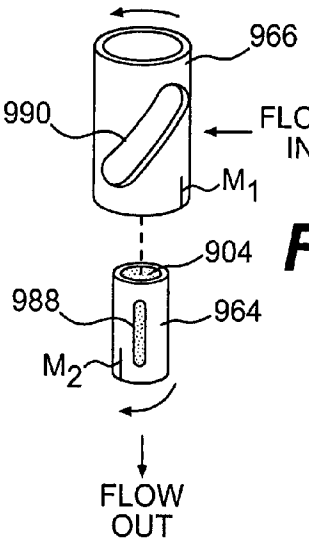
FIG. 9 is an exploded view showing a flow regulating portion of a ninth embodiment of the present invention.

In FIG. 9, the flow adjustment mechanism of a ninth embodiment is shown. ON this embodiment, the PFCM 904 is a rigid cylinder of porous material and is disposed within an inner sleeve 964 that has a vertical slot 988 cut in the side. An outer sleeve 966 having a sloped slot 990, is disposed around the inner sleeve 964 and is rotatable relative thereto. The PFCM 9054 of this embodiment is preferably manufactured by one or more of the manufacturing methods disclosed above with respect to the first embodiment.

In operation, when the two sleeves 964 and 966 are assembled and positioned such that two reference marks $M_1$ and $M_2$ are aligned, the vertical slot 988 of the inner sleeve 964 will not overlap with the sloped slot 990 of the outer sleeve and the dispenser assembly will be in a closed, non-dispensing state. When the dispenser assembly is operated by a user, the sleeves 964 and 966 will turn relative to one another, in the respective directions shown in FIG. 9, such that the slots 988 and 990 will begin to overlap at their upper ends. The beverage, which is supplied to the sloped slot 990, is then able to flow through the overlap of the slots 988 and 990 and through substantially the entire length of the PFCM 904. As the two sleeves 964 and 966 are further rotated with respect to one another, the position of the overlap of the slots 988 and 990 will move from their upper ends to their lower ends, thus reducing the length of the PFCM 904 through which the beverage must pass during dispensing.

Tenth Embodiment

Figure 10:
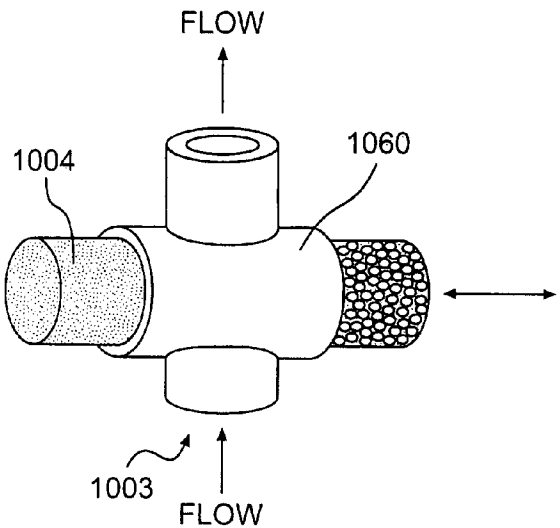
FIG. 10 is a partial perspective view showing a flow regulating portion of a tenth embodiment of the present invention.

In FIG. 10, the flow adjustment mechanism of a tenth embodiment is shown. In this embodiment, a PFCM 1004 is constructed as a rigid cylinder having varying porosity in its axial direction. The PFCM 1004 is disposed in a dispenser body 1060 perpendicular to a flow passage 1003 formed in the dispenser body 1060, such that the beverage must pass through the PFCM 1004 before being dispensed. A first end (the left side in FIG. 10) of the PFCM 1004 has low porosity, while a second end (the right side in FIG. 10) is highly porous. The PFCM 1004 can be a single piece of material with gradually increasing porosity from the first end to the second end. Alternatively, the PFCM 1004 can be formed from a number of separate sections, each having different porosity, so as to produce a stepwise increase in porosity from the first end to the second end. Moreover, the change in porosity from the first end to the second end can be achieved by increasing the particle size, the void size, or both from the first end to the second end. The PFCM 1004 of this embodiment is preferably manufactured by one or more of the manufacturing methods disclosed above with respect to the first embodiment.

The PFCM 1004 is shown in FIG. 10 in a medium flow position, wherein the beverage must pass through a section of the PFCM 1004 having a medium amount of porosity and, thus, a medium amount of resistance to flow of the beverage. Moving the PFCM 1004 leftward in FIG. 10, relative to the dispenser body 1060, will increase the rate of flow, while opposite motion of the PFCM 1004 will decrease the rate of flow of the beverage.

A dispenser assembly using the flow control mechanism of the tenth embodiment could employ a separate external on/off valve to control dispensing of the beverage. Alternatively, the first, low porosity, end of the PFCM 1004 could be made completely non-porous, such that when the PFCM 4 is translated completely to the right in FIG. 10, the non-porous section of the PFCM 1004 would be positioned in the flow passage 1003 of the dispenser body 1060 to seal the dispenser assembly in a non-dispensing state.

Eleventh Embodiment

Figure 11:
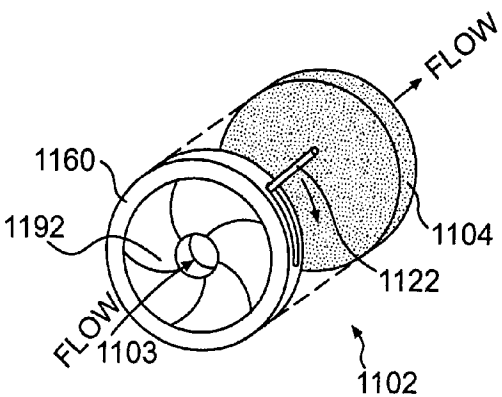
FIG. 11 is a partial perspective view showing a flow regulating portion of an eleventh embodiment of the present invention.

In the eleventh embodiment, shown in FIG. 11, the resistance to flow of the beverage is varied by changing the area of a PFCM 1104, through which the beverage is allowed to flow. The PFCM 1104 of this embodiment is preferably manufactured in the same manner as that of the first embodiment described above. Specifically, the dispenser body 1160 includes an iris 1192 positioned adjacent to the PFCM 1104 and sealed thereto. The iris 1192 controls the size of a flow passage 1103 through which the beverage can flow, such that as the iris 1192 is adjusted, the area of the flow passage 1103, and hence the PFCM 1104 through which the beverage can flow, is correspondingly adjusted. The iris 1192 is similar to those conventionally used in photography, and since the mechanics of the iris 1192 are not a feature of the present invention, they will not be further discussed herein.

The iris 1192 in FIG. 11 is shown in a low flow condition, wherein only a small flow passage 1103 is provided for flow of the beverage. To increase the rate of flow, a user simply moves actuator 1122 in the direction of the arrow in FIG. 11, which in turn adjusts the area of the flow passage 1103 by opening the iris 1192. Thus, the PFCM 1104 is operable to vary the resistance to flow of the beverage in accordance with the area of the PFCM 1104 exposed to flow of the beverage. That is, the resistance provided by the PFCM 1104 changes in correspondence with the area exposed to flow of the beverage. By increasing the area of the flow passage 1103, the beverage is allowed to flow through a greater area of the PFCM 1104, the resistance to flow of the beverage is decreased, and the flow rate is increased.

Twelfth Embodiment

Figure 12A:
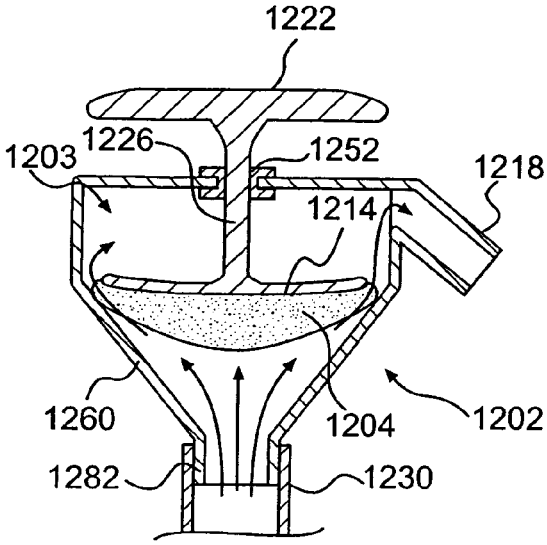
FIG. 12A is a section view showing a twelfth embodiment of the dispenser assembly of the present invention in an open, dispensing state.
Figure 12B:
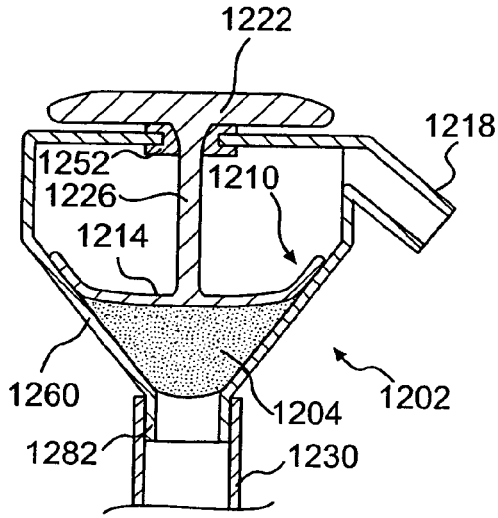
FIG. 12B is a section view showing the twelfth embodiment of the dispenser assembly of the present invention in a closed, non-dispensing state.

A dispenser assembly 1202 according to a twelfth embodiment is shown in FIGS. 12A and 12B. In this embodiment, the dispenser assembly 1202 generally comprises a dispenser body 1260, a PFCM 1204, and an actuator 1222. The dispenser body 1260 defines a flow passage 1203 in its interior for flow of the beverage through the dispenser assembly 1202 during dispensing. An inlet 1282 is formed at the lower portion of the dispenser body 1260 for connection of a dip tube 1230 to supply the beverage to the dispenser assembly 1202. A support plate 1214 is disposed within the dispenser body 1260 and is connected to the actuator 1222 by a guide member 1226, which extends through an aperture in the top surface of the dispenser body 1260. An actuator seal 1252 is disposed in the aperture to seal between the dispenser body and the guide member 1226, and thereby prevent the beverage from escaping through the aperture during dispensing. While not shown in FIGS. 12A and 12B, any of the attachment portions discussed above could be used to secure the dispenser assembly 1202 to a container.

In this embodiment, the PFCM 1204 is constructed as sack filled with granular particles, beads, or pellets. The sack can be constructed of any suitable material that is permeable by liquids, in particular beverage, and that will not deteriorate during use. Preferably the granular particles are small glass beads, however, the particles could also be grains of sand, polymeric beads or pellets, ceramic beads or pellets, metallic bead or pellets, or the like. The PFCM 1204 is suspended from the underside of the support plate 1214 so that it hangs loosely in the flow passage 3, as shown in FIG. 12A.

In FIG. 12A, the dispenser assembly 1202 is shown in a high flow position. In this position, the particles in the PFCM 1204 are loosely distributed in the flow passage 1203 within the sack, and the beverage is able to flow through the interstitial spaces in the PFCM 1204 with minimal restriction. As the actuator 1222 is depressed, the particles start to become more tightly compressed and the interstitial spaces between particles become smaller. This compression of the particles restricts the flow of the beverage through the flow passage 1203 and decreases the rate at which the beverage is dispensed. In FIG. 12B, the dispenser assembly 1202 is shown in a closed, non-dispensing state, wherein the PFCM 1204 is substantially compressed and the edge of the support plate 1214 is deflected. The edge of the support plate 1214 seals against the lower portion of the dispenser body and serves as a valve 1210. While not illustrated, the actuator 1222 could be secured in the non-dispensing position by a threaded engagement between the guide member 1226 and the dispenser body 1260, by a latch mechanism, or by another suitable securing device.

Thirteenth Embodiment

Figure 13A:
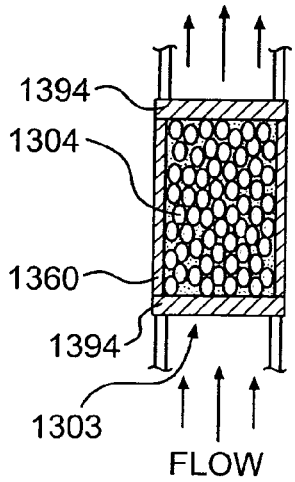
FIG. 13A is a section view showing a flow regulation portion of a thirteenth embodiment of the of the present invention in a high flow/low resistance state.
Figure 13B:
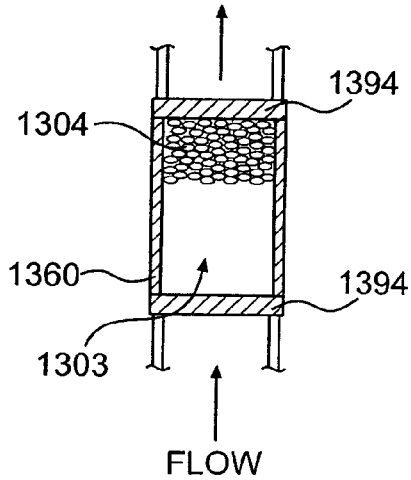
FIG. 13B is a section view showing a flow regulation portion of a thirteenth embodiment of the of the present invention in a low flow/high resistance state.

The flow adjustment mechanism of a dispenser assembly according to the thirteenth embodiment is shown in FIGS. 13A and 13B. In this embodiment, a dispenser body 1360 defines a flow passage 1303 therethrough. A PFCM 1304 is disposed in the flow passage 1303 and automatically regulates the flow of the beverage through the dispenser body 1360. Screens 1394 are disposed at each end of the dispenser body 1360 to retain the PFCM 1304 within the flow passage 1303.

The PFCM 1304, of this embodiment is made of deformable pressure-sensitive particles. By deformable pressure-sensitive particles, it is meant particles that are capable of changing size in accordance with a change in external pressure, such as hollow elastic spheres similar to balloons, foam spheres having an impermeable outer surface, or other appropriate particles. For example, when exposed to a high pressure, such as inside a pressurized beverage bottle, the deformable pressure-sensitive particles are compressed to a small particle size, as shown in FIG. 13B. When the pressure to which the particles are exposed is lower, such as when the carbonated beverage in the container is substantially depleted, the particles will expand as shown in FIG. 13A. Preferably the particles are buoyant in the beverage, such that they float as shown in FIG. 13B.

In the embodiment shown, a separate external on/off valve (not shown) can be used to open or close a dispenser assembly that incorporates the dispenser body 1360 of the thirteenth embodiment. When a user opens the external valve for the first time to begin dispensing beverage from a full bottle, the pressure sensitive particles of the PFCM 1304 will be substantially compressed, as shown in FIG. 13B. At this time, the particles will be packed closely together and the interstitial spaces between particles will be small, i.e., the particles have a high packing density. Thus, the flow of the beverage will be substantially restricted. As the beverage is dispensed and the pressure within the container decreases, the particles will gradually expand until, when the bottle is almost empty, the particles substantially fill the space between the screens 1394, as shown in FIG. 13A. At this point, the particles will be spaced further apart and the resulting interstitial spaces will be large, i.e., the particles have a low packing density. Thus, the beverage will be able to flow easily through the large interstitial spaces between the particles with little resistance. In this manner, the PFCM 1304 of the thirteenth embodiment automatically regulates the rate of dispensing of the beverage to produce a constant, controlled, steady flow, regardless of the pressure in the container.

In a variation of the thirteenth embodiment, the PFCM 1304 could contain a material that is soluble in the beverage, such as, for example, a block or blocks of sugar (not shown). In this variation, when the container is first opened and the pressure in the container is at its maximum, the PFCM 1304 would be packed tightly with large blocks of the soluble material, such that the flow of the beverage through the PFCM 1304 would be greatly restricted. As the beverage flows past the PFCM 1304 during dispensing, the soluble material of the PFCM 1304 will begin to dissolve, thus gradually reducing the resistance to flow of the beverage. The pressure within the container will, of course, gradually decrease as the carbonated beverage is depleted. Accordingly, the soluble material should be selected to have a solubility rate proportional to the rate of pressure decrease as the beverage is dispensed. This will allow the PFCM 1304 to automatically regulate the rate at which the beverage is dispensed to produce a constant, controlled flow, regardless of the change in pressure inside the container.

While the invention is described in terms of the presently preferred embodiments, it is understood that the features of these embodiments could be interchanged and/or combined to achieve other variations of the present invention, without departing from the spirit and scope of the present invention. For example, in some of the embodiments the valve is shown as being integral with the dispenser housing, while in other embodiments the valve is shown as being a separate element. It should be understood that any of the disclosed embodiments could be made with an integral or separate valve as appropriate in the given application. Further, while the PFCMs of the first through the seventh embodiments are shown as having a generally cylindrical shape, any appropriate elongated shape could be used. For example, the various PFCMs could be constructed as elongated members having square, triangular, elliptical, hexagonal, or other bounded cross-sectional shapes. Further, the PFCMs are shown as having a constant cross section over their length; however, it may be desirable for the cross section of the PFCMs to be variable over their lengths.

Various preferred materials and methods of manufacturing the PFCM are disclosed with respect to the various embodiments. The specific materials and methods used to make the PFCMs will, of course, depend on the desired characteristics of the PFCMs, such as porosity, density, solubility, hardness, elasticity, etc. The present inventors anticipate that the materials and methods disclosed herein may be used in different combinations with each other, and in combinations with other materials and/or methods to produce PFCMs having the characteristics desired for a given application.

While the dispenser assemblies of the present invention are disclosed for use on a pressurized beverage bottle, the present inventors anticipate various other uses for the various dispenser bodies, and valves, of the disclosed embodiments could be used without the additional structure required to adapt them for use with a pressurized beverage container. For example, the flow regulating portions of the present invention may also be adapted for use in connection with blood oxygenation equipment, automatic flow regulators, filtering equipment, or any other application where it is desirable to control the flow of a liquid containing dissolved gas(es) where there is a concern about keeping the gas(es) in solution. equipment, or any other application where it is desirable to control the flow of a liquid containing dissolved gas(es) where there is a concern about keeping the gas(es) in solution.

We claim:

1. A dispenser assembly for dispensing a liquid from a container, said dispenser assembly comprising:

a dispenser body defining a flow passage; and a porous flow control member having a length and positioned in the flow passage such that at least some of the liquid must pass through at least a portion of said porous flow control member before being dispensed, wherein said porous flow control member has varying porosity over its length and is movable relative to the flow passage to vary a length of said porous flow control member that the liquid must pass through before being dispensed, in order to vary the resistance to the flow of the liquid and to vary the porosity of the portion of said porous flow control member through which the liquid must pass before being dispensed.

2. A dispenser assembly as set forth in claim 1, further comprising a valve, movable between an open position that allows the liquid to be dispensed and a closed position that prevents the liquid from being dispensed.

3. A dispenser assembly as set forth in claim 1, further comprising:

a discharge spout that directs the flow of discharged liquid; and a dip tube attached to said dispenser body and extending inside the container to supply the liquid to said dispenser body to be discharged.

4. A dispenser assembly as set forth in claim 1, further comprising an attachment portion for attaching said dispenser assembly to the container.

5. A dispenser assembly as set forth in claim 4, wherein said dispenser body is formed integrally with the container.

6. A dispenser assembly as set forth in claim 1, wherein said porous flow control member comprises a piece of rigid material.

7. A dispenser assembly for dispensing a liquid from a container, said dispenser assembly comprising:

a dispenser body defining a plurality of flow passages; and a plurality of porous flow control members, wherein each of the flow passage has one of the plurality of porous flow control members disposed therein such that at least some of the liquid must pass through at least a portion of one of the porous flow control members before being dispensed, wherein said dispenser assembly is operable to vary a resistance to flow of the liquid through said dispenser assembly by adjusting usage of the plurality of flow passages, and wherein each of said plurality of porous flow control members has a different length, such that the resistance to flow of the liquid can be varied by selecting which of said plurality of flow passages the liquid is allowed to flow through during dispensing.

8. The dispenser assembly as set forth in claim 7, wherein the number of the plurality of flow passages, through which the liquid flows during dispensing is selectable, in order to vary the resistance to the flow of the liquid.

9. A dispenser assembly as set forth in claim 1, wherein the area of said porous flow control member through which the liquid is allowed to flow during dispensing is variable in order to vary the resistance to flow of the liquid through the flow passage.

10. A dispenser assembly as set forth in claim 1, wherein said porous flow control member is made of a porous material selected from the group consisting of ceramics, metals, glass structures, plastics, organic structures, polymers, and composites thereof.

11. A dispenser assembly as set forth in claim 1, wherein said porous now control member is made of a material selected from the group consisting of sintered materials, granular materials, fibrous materials, and foamed materials.

12. A dispenser assembly as set forth in claim 1, wherein said porous flow control member comprises a plurality of glass beads.

13. A dispenser assembly as set forth in claim 1, wherein the liquid to be dispensed is a carbonated beverage.

14. A dispenser assembly for dispensing a liquid from a container, said dispenser assembly comprising:

a dispenser body defining a flow passage; and a porous flow control member having a length and positioned in the flow passage such that at least some of the liquid must pass through at least a portion of said porous flow control member before being dispensed, wherein said porous flow control member is configured to provide a varying resistance to the flow of liquid along it length and is movable relative to the flow passage, such that movement of the porous flow control member varies a length of the portion of said porous flow control member through which the liquid must pass before being dispensed;

a valve, movable between an open position that allows the liquid to be dispensed and a closed position that prevents the liquid from being dispensed;

a discharge spout that directs the flow of discharged liquid;

a dip tube attached to said dispenser body and extending inside the container to supply the liquid to be discharged to said dispenser body; and an attachment portion for attaching said dispenser assembly to the container.

15. An assembly for dispensing a carbonated beverage, comprising:

a container for containing a carbonated beverage;

a dispenser body defining a flow passage and attached to said container by an attachment portion;

a porous flow control member positioned in the flow passage such that at least some of the beverage must pass through at least a portion of said porous flow control member before being dispensed;

a valve, movable between an open position that allows the beverage to be dispensed and a closed position that prevents the beverage from being dispensed; and a dip tube attached to said dispenser body and extending inside the container to supply the beverage to said dispenser body to be discharged, wherein said porous flow control member has varying porosity over its length and is movable relative to the flow passage, such that moving the porous flow control member within the flow passage varies a length and the porosity of the portion of said porous flow control member through which the liquid must pass before being dispensed in order to vary the resistance to flow of the liquid through the flow passage during dispensing.

* * * * *

UNITED STATES PATENT AND TRADEMARK OFFICE

CERTIFICATE OF CORRECTION

PATENT NO. : 7,631,786 B2
APPLICATION NO. : 11/081280
DATED : December 15, 2009
INVENTOR(S) : Finlay et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 837 days.

Signed and Sealed this

Second Day of November, 2010

David J. Kappos

David J. Kappos
*Director of the United States Patent and Trademark Office*